United States Patent [19]

Boardman

[11] Patent Number: 4,637,654

[45] Date of Patent: Jan. 20, 1987

[54] ARMCHAIR WITH TILTING SEAT

[76] Inventor: Paul A. Boardman, 16 Woodman's Way, Bishops Cleeve, Cheltenham GL524DP, England

[21] Appl. No.: 702,654

[22] Filed: Feb. 19, 1985

[30] Foreign Application Priority Data

Jun. 18, 1984 [GB] United Kingdom ..... PCT/GB84/00215

[51] Int. Cl.[4] ..... A47C 1/02

[52] U.S. Cl. ..... 297/337; 297/DIG. 10

[58] Field of Search ..... 297/DIG. 10, 337, 338, 297/323

[56] References Cited

U.S. PATENT DOCUMENTS

| | | | |
|---|---|---|---|
| 3,259,427 | 7/1966 | Wiest | 297/DIG. 10 |
| 3,640,566 | 2/1972 | Hodge | 297/DIG. 10 |
| 3,820,845 | 6/1974 | Persson | 297/287 |
| 3,954,195 | 5/1976 | Deuchar | 297/DIG. 10 |
| 4,031,576 | 6/1977 | Epstein | 297/DIG. 10 |
| 4,120,530 | 10/1978 | Imbro | 297/DIG. 10 |
| 4,141,094 | 2/1979 | Ferguson et al. | 297/DIG. 10 |

*Primary Examiner*—Francis K. Zugel

*Attorney, Agent, or Firm*—B. J. Powell

[57] ABSTRACT

An armchair (10) having a seat (16) tiltable relative to a fixed frame (12,14,18) of the chair to provide aid to an occupant in rising from the chair, the seat being tiltable from a lowered position to a raised position by a lever mechanism (24) provided beneath the seat, characterized in that the lever mechanism is operatively connected to at least one pivotal arm assembly (20,22) of the chair and is actuated by downward movement of that arm by force exerted thereon by the occupant in rising from the chair.

16 Claims, 7 Drawing Figures

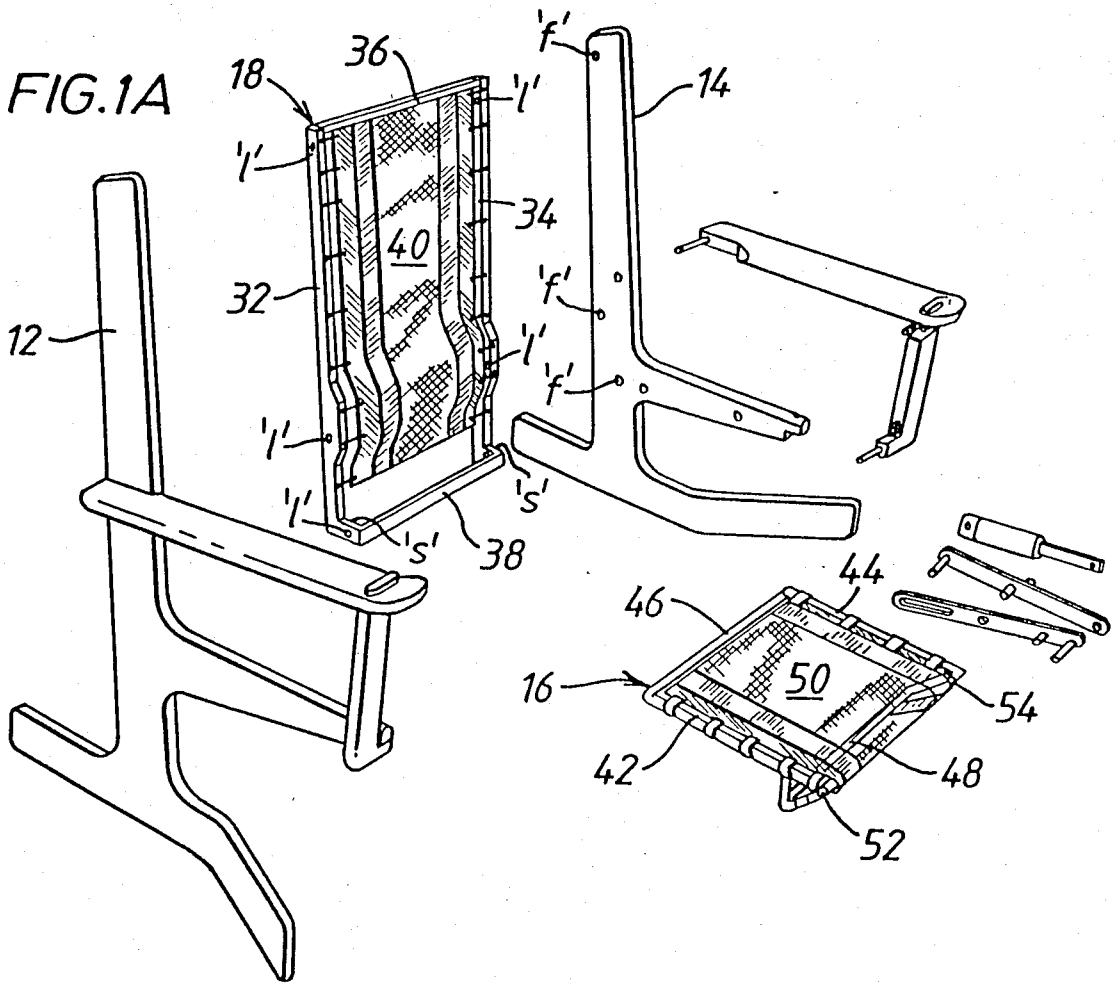
14
'f'
'f'
'f'
'l'
34
'l'
'l'
'l'

FIG. 2
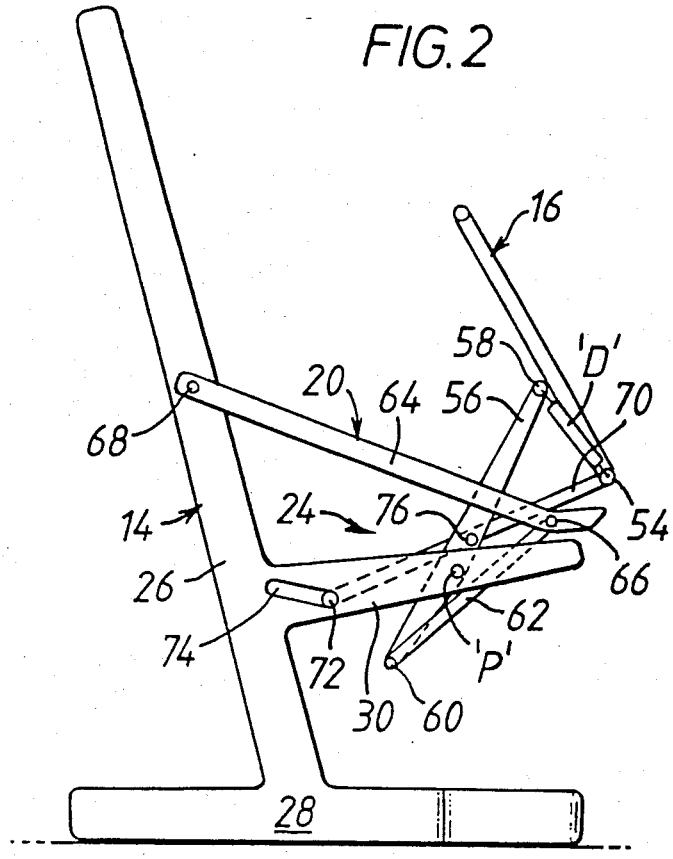
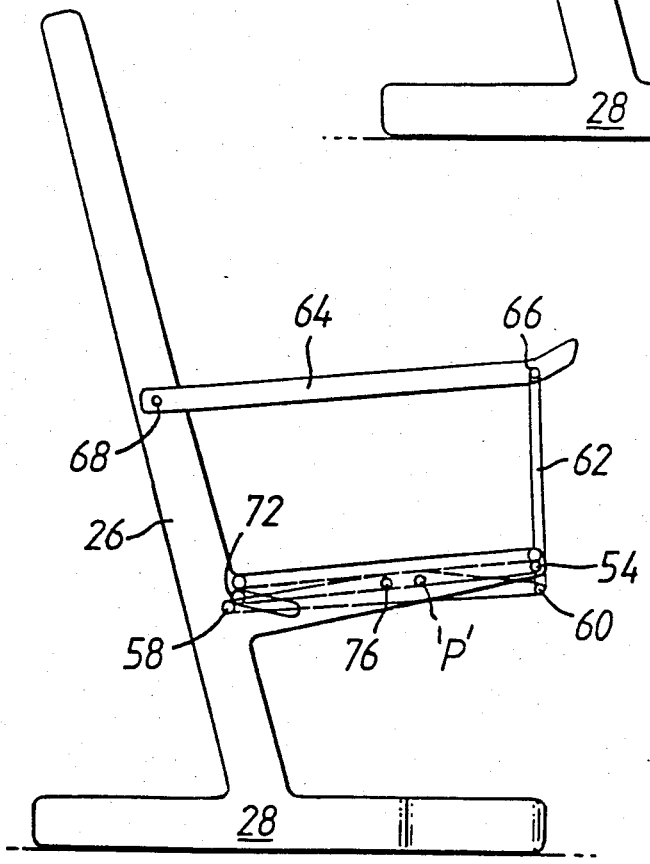
FIG. 3

ARMCHAIR WITH TILTING SEAT

TECHNICAL FIELD

This invention relates to an armchair having a tiltable seat to provide aid to an occupant in rising from the seat.

BACKGROUND ART

Chairs having tiltable seats are known in the art. For example, a chair having a seat in which the tilting movement is actuated by spring-loading designed specifically for a particular user is known. It is also known to provide a chair with a tiltable seat in which the tilting movement is pneumatically or electrically controlled. However, these seats tend to be expensive, bulky and difficult to operate by infirm or elderly persons.

DISCLOSURE OF THE INVENTION

The present invention seeks to overcome the disadvantages of prior constructions by providing a chair with a tiltable seat which is actuated by a relatively simple mechanism and which utilizes the normal force which an occupant exerts in rising from the seat.

To this end, the invention provides an armchair having a seat tiltable relative to a fixed frame of the chair to provide aid to an occupant in rising from the chair, the seat being tiltable from a lowered position to a raised position by a lever mechanism provided beneath the seat, characterised in that the lever mechanism is operatively connected to at least one pivotal arm assembly of the chair and is actuated by downward movement of that arm by force exerted thereon by the occupant in rising from the chair.

An embodiment of the invention will now be described, by way of example, with reference to the accompanying drawings.

BRIEF DESCRIPTION OF THE DRAWINGS

FIG. 1A is an exploded view of the main structural components of the chair;

FIG. 2 is a side view of one side frame member of the chair showing the seat in a tilted and raised position;

FIG. 3 is a side view similar to FIG. 2 but showing the seat in a lowered position as normally occupied.

BEST MODE FOR CARRYING OUT THE INVENTION

Figure 1:
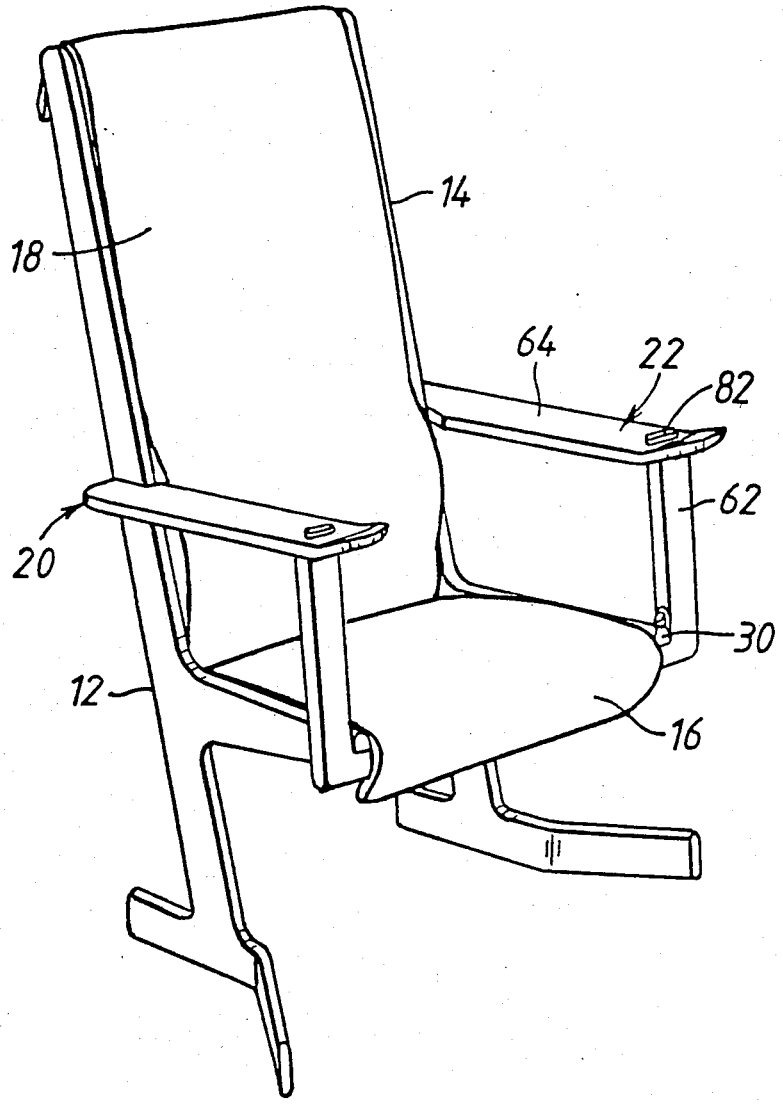
FIG. 1 is a perspective view of an armchair according to the invention.
Figure 4:
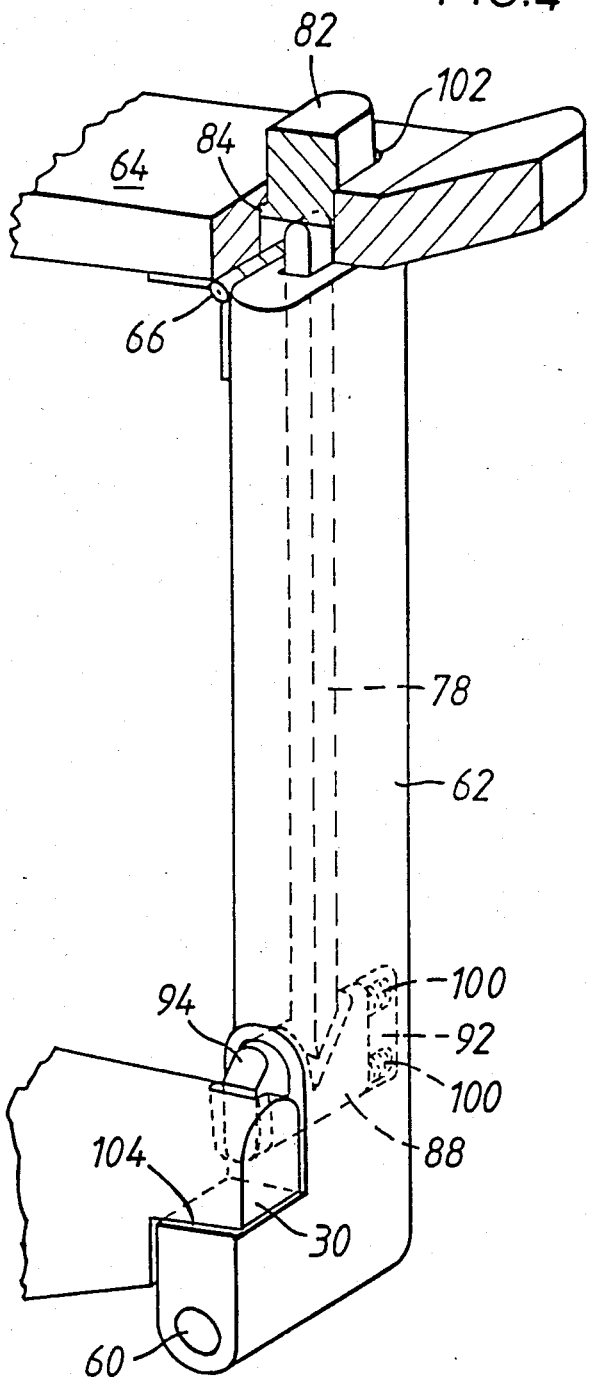
FIG. 4 is a part-sectional perspective view of a pivotal arm assembly incorporating locking means by which the tilting mechanism is held locked relative to the fixed frame of the chair.
Figure 5:
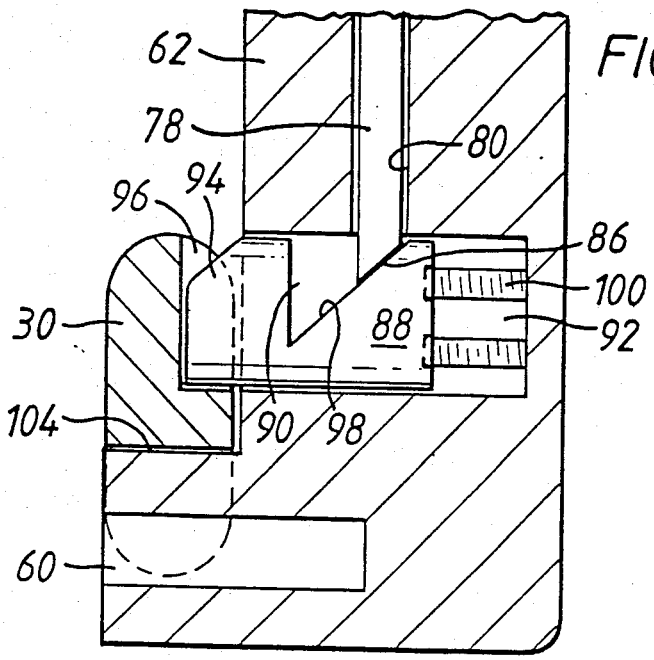
FIG. 5 is a detailed cross-sectional view of the locking means shown in locked condition.
Figure 6:
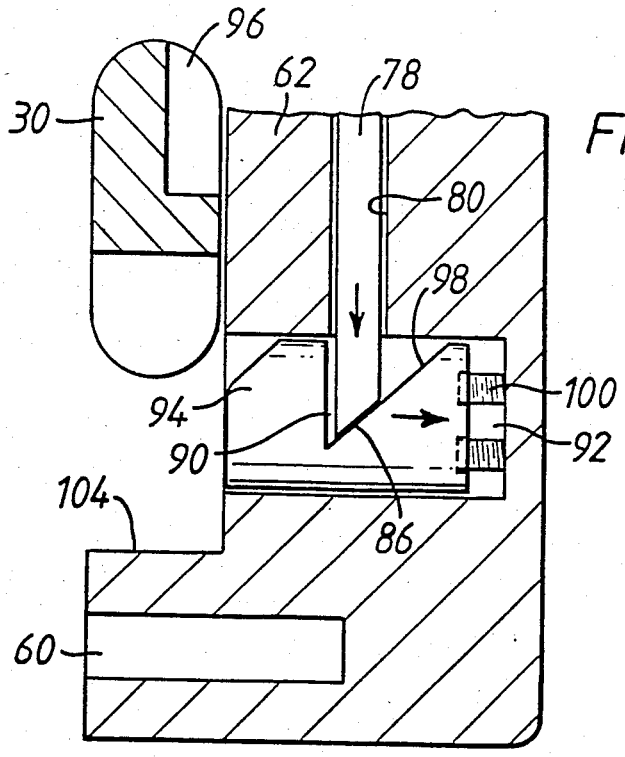
FIG. 6 is a view similar to FIG. 5 but showing the locking means in a released condition.

Referring to the drawings, the armchair 10 is of modular construction of which the main structural components comprise a pair of similar side frames 12, 14 respectively, interconnected and spaced apart by a tiltable seat pan 16; a back frame 18, and a pair of pivotal arm assemblies 20, 22 respectively, each of which actuates a seat tilting mechanism such as mechanism 24.

Side frame 14 comprises a main upright strut 26, a foot 28 integral with upright strut 26 and a forwardly projecting support member 30 also integral with the upright strut intermediate its ends. Side frame 12 is of similar construction.

The back frame 18 is a simple rectangular frame comprising longitudinal and transverse frame elements 32,34 and 36,38 respectively. The longitudinal frame elements are formed with fastening locations 'l' at which the side frames are connected to the back frame by suitable fasteners at fixing locations 'f'. The transverse frame element 38 is displaced forwardly of the plane containing the other frame elements and thereby provides a step 's' on which the rear-most part of the seat pan is supported when the seat is in its lowered (substantially horizontal) position. The back frame is in-filled by a suitable material, which may be attached to the longitudinal frame elements as shown in order to provide the chair back 40.

The seat pan 16 also comprises a generally rectangular frame comprising longitudinal and transverse frame elements 42,44 and 46,48, respectively. The forward transverse frame element 48 is displaced rearwardly and below the longitudinal frame elements so that the frame in-fill material 50 is wrapped over the leading edge of the seat to aid comfort of the user. The forward end of each of the longitudinal frame elements is furnished with a journal bush 52 and 54, respectively, by which the leading edge of of the seat is pivotally connected to the tilting mechanism 24.

The seat tilting mechanism will now be described with reference to mechanism 24 associated with side frame 14, it being understood that a similar mechanism is associated with the other side frame 12.

Mechanism 24 comprises a main tilting lever 56 which is pivotally mounted at 'P' intermediate its ends to support member 30 of side frame 14. One end of lever 56 carries a stub shaft 58 which engages beneath seat pan longitudinal frame element 44.

The stub shaft 58 may be replaced by a rod which connects together the main tilting levers of both tilting mechanisms and which extends across the seat pan 16. The opposite end of main tilting lever 56 is pivotally mounted at 60 to the lower end of a connecting strut 62 of pivotal arm assembly 22. The upper end of strut 62 is hinged to the forward end of pivotal arm 64 of the assembly 22 by means of a hinged connection 66. The rearward end of pivotal arm 64 is pivotally mounted to the side frame 14 by pivotal connection 68.

In order to provide simultaneous lifting and forward movement of the seat pan 16, a main lifting lever 70 has one of its ends pivotally journalled to the leading edge of the seat frame by means of a pivotal connection to journal bush 54 and has its opposite end pivotally and slidably mounted to the support member 30 adjacent upright strut 26 by means of pivot 72 mounted within slider 74. The main lifting lever 70 is interconnected with the main tilting lever 56 intermediate their ends by means of pivotal connection 76.

The seat tilting mechanism 24 is actuated by pivotal movement of the arm assembly 22 as will now be described.

The connecting strut 62 of the arm assembly 22 is of hollow construction and houses a reciprocal actuator push rod 78 which slides in a through bore 80 of the strut 62. The upper end of push rod 78 abuts the undersurface of an actuating button 82 within button recess 84. The lower end of the push rod is formed to provide an inclined face 86 which cooperates with detent 88 having a cunieform recess 90 in its mid-section. Detent 88 is slidably accommodated within a blind bore 92 extending transversely of the strut adjacent its lower end. The detent has a locking nose portion 94 which normally protrudes proud of the mouth of blind bore 92 and engages in a recessed step 96 provided at the forward end of support member 30 thereby to hold the pivotal arm assembly locked to the support member against pivotal movement.

In order to release strut 62 to permit pivotal movement of the arm assembly 22 the push rod is caused to move downwardly whereby the inclined surface 86 acts on the oppositely inclined surface 98 of the detent midsection and forces the detent to slide inwardly of blind recess 92 against the force of compression spring 100. Thus, the nose portion 94 is retracted out of engagement with the recess step 96 to unlock the pivotal arm assembly.

The actuating button extends through an aperture 102 provided at the forward end of pivotal arm 64 so that an exposed portion of the button stands proud of the pivotal arm 64 and is depressed to cause a downward movement of the push rod.

The lower end of strut 62 is formed with a stepped portion 104 which seats in an oppositely stepped portion provided in the lower forward end of support member 30 when the arm assembly is in its locked condition.

The other arm assembly 20 is similarly constructed. When both arm assemblies are in their locked positions, the pivotal arms thereof are in a substantially horizontal position and the connecting struts are in an upright position as shown in solid lines in FIG. 3. Moreover, in this condition the seat pan 16 is in its lowered position i.e. substantially horizontal and the main levers of the tilting mechanism 56 and 70 are in folded condition adjacent the inner faces of the support members of their respective side frames. Hence, the chair may be used as a normal arm chair.

In order to benefit from the aid a user derives in rising from the chair by the tiltable seat, the occupant first depresses the actuating buttons of each arm assembly simultaneously so as to unlock those assemblies. The occupant thereafter actuates the seat tilting mechanism by pushing downwardly on the forward ends of the pivotal arms during rising and also shifts forwardly in the seat. This is a quite natural movement normally affected in rising from an armchair.

However, in the chair according to this invention, such rising movement by the occupant operates the tilting mechanism again referred to in relation to mechanism 24. As the pivotal arm 64 moves downwardly about pivot 68, connecting strut 62 pivots anti-clockwise about hinge 66 thereby causing the main tilting lever 56 to rotate clockwise about pivots 60 and 'P'. Thus, stub shaft 58 pushes upwardly against the seat frame and in so doing executes a relative sliding movement with respect thereto travelling forwardly of the seat frame. Thus, the seat is caused to pivot about its journalled forward end e.g. jounal bush 54 in a clockwise direction whereby the rear of the seat frame is raised relative to its front end.

Since levers 56 and 70 are interconnected, clockwise rotation of lever 56 also causes pivot 76 to shift relative to fixed pivot 'P' and thus the pivotal movement of lever 56 is accompanied by a generally forward sliding movement of pivot 72 relative to slider 74 during anti-clockwise rotation of lever 70 about pivot 72. Thus, the leading edge of the seat simultaneously is raised and moved forwardly relative to the support member 30. Hence, the scissor-like assembly of levers 56 and 70 is 'opened' when the seat is in its raised and tilted condition.

When the occupant returns to the chair and sits upon the seat, the occupant's body-weight causes the seat to be lowered thus 'closing' the scissor-like mechanism to its initial position. The connecting strut detents automatically lock into the support members due to their spring loaded bias and due to the ramp surface provided at the tip of the detent nose portion.

As shown in FIG. 1 the feet of the side frames have divergent forward facing portions to provide a stable base for the chair. Further, this arrangement allows a user having a walking air to approach the chair more easily.

In order to allow the seat to return gradually to its lowered position a one-way damping device 'D', which may be a pneumatic piston and cylinder device is interconnected between pivot 54 and 58 thereby to retard lowering movement of the seat. It is to be understood that the relative ratios of the lever sizes and their pivotal locations can be adjusted to provide different tilt angles of the seat and to vary the height to which the seat is raised. For example, where the damping device 'D' is a pneumatic piston and cylinder device the angle of inclination of the raised seat is arranged to be less acute so that end 58 of the main tilting lever travels a smaller distance relative to the seat frame.

I claim:

1. An armchair having a seat tiltable relative to a fixed frame of the chair to provide aid to an occupant in rising from the chair, the seat being tiltable from a lowered position to a raised position by a lever mechanism provided beneath the seat, characterised in that the lever mechanism is operatively connected to at least one pivotal arm assembly of the chair and is actuated by downward movement of that arm by force exerted thereon by the occupant in rising from the chair, the fixed frame of the seat comprising a cantilevered support element about which the lever mechanism is pivotal and in that locking means is provided to lock said pivotal arm assembly relative to the support element and thereby arrest movement of the lever mechanism when the chair is in use, said pivotal arm assembly comprising a pivotal arm pivotally mounted to a part of the fixed frame above said cantilevered support element and a connecting strut having one end pivotally connected to the pivotal arm remote from its pivotal mounting and an opposite end connected to one end of a main tilting lever of the lever mechanism said opposite end of the arm also incorporating the locking means by which the pivotal arm assembly is locked relative to the fixed frame.

2. An armchair according to claim 1, further characterised in that the lever mechanism causes the rear of the seat to tilt forwardly relative to a forward part of the seat and simultaneously raises and moves the seat forwardly relative to the fixed frame.

3. An armchair according to claim 1, further characterised in that said main tilting lever is pivotally mounted intermediate its ends to said cantilever support member and has an opposite end located for abutment with the chair seat such as to tilt a rear part of the seat relative to a forward end thereof during rotation of the main tilting lwever with respect to said cantilevered support member.

4. An armchair according to claim 3, further characterised in that a main lifting lever pivotally is connected to said main tilting lever intermediate the ends of those levers to form a scissor-like assembly, in that one end of the main lifting lever pivotally is mounted to a forward part of the seat and in that the opposite end of the main lifting lever is pivotally and slidably mounted to said cantilevered support member rearwardly of the pivotal connection between the main tilting lever and the cantilevered support member.

5. An armchair according to claim 1 further characterised in that the locking means comprises a detent housed in said connecting strut of the pivotal arm assembly which detent engages a forward end of said cantilevered support element and in that the detent is movable out of locking engagement with said cantilevered support element by a reciprocal rod movable by an actuating button provided at the forward end of the pivotal arm of the arm assembly.

6. An armchair according to claim 3 further characterised in that the locking means comprises a detent housed in said connecting strut of the pivotal arm assembly which detent engages a forward end of said cantilevered support element and in that the detent is movable out of locking engagement with said cantilevered support element by a reciprocal rod movable by an actuating button provided at the forward end of the pivotal arm of the arm assembly.

7. An armchair according to claim 5, further characterised in that the detent is resiliently biased automatically to lock the pivotal arm assembly when the seat is returned to its lowered position.

8. An armchair according to claim 4 further characterised in that the locking means comprises a detent housed in said connecting strut of the pivotal arm assembly which detent engages a forward end of said cantilevered support element and in that the detent is movable out of locking engagement with said cantilevered support element by a reciprocal rod movable by an actuating button provided at the forward end of the pivotal arm of the arm assembly.

9. An armchair having a fixed frame and a seat tiltable relative to said fixed frame of the chair to provide aid to an occupant in rising from the chair, the seat being tiltable from a lowered position to a raised position by a lever mechanism provided beneath the seat, characterised in that the lever mechanism operatively is connected to at least one pivotal arm rest assembly of the chair and to said fixed frame, said arm rest assembly being disposed above the level of said seat when the seat is in its lowered position and having a rear part pivotally connected to said fixed frame and a forward part remote from said pivotal connection and in that said lever mechanism is actuated by downward pivotal movement of said forward part of said arm rest assembly by force exerted thereon by the occupant in rising from the chair.

10. An armchair according to claim 9, further characterised in that the lever mechanism causes the rear of the seat to tilt forwardly relative to a forward part of the seat and simultaneously raises and moves the seat forwardly relative to the fixed frame.

11. An armchair according to claim 10 further characterised in that the fixed frame of the seat comprises a cantilevered support element about which the lever mechanism is pivotal and in that locking means is provided to lock said pivotal arm rest assembly relative to the support element and thereby arrest movement of the lever mechanism when pivotal movement of said seat is not required.

12. An armchair according to claim 11, further characterised in that said forward and rear parts of the pivotal arm rest assembly are provided by a pivotal arm said rear part of which is pivotally mounted to a part of the fixed frame above said cantilevered support element and wherein a connecting strut is provided and includes one end pivotally connected to said forward part of the pivotal arm and an opposite end connected to one end of a main tilting lever of the lever mechanism said opposite end of the arm also incorporating the locking means by which the pivotal arm rest assembly is locked relative to the fixed frame.

13. An armchair according to claim 12, further characterised in that said main tilting lever is pivotally mounted intermediate its ends to said cantilever support member and has an opposite end located for abutment with the chair seat such as to tilt a rear part of the seat relative to a forward end thereof during rotation of the main tilting lever with respect to said cantilevered support member.

14. An armchair according to claim 13, further characterised in that a main lifting lever pivotally is connected to said main lifting lever intermediate the ends of those levers to form a scissor-like assembly, in that one end of the main lifting lever pivotally is mounted to a forward part of the seat and in that the opposite end of the main lifting lever is pivotally and slidably mounted to said cantilevered support member rearwardly of the pivotal connection between the main tilting lever and the cantilevered support member.

15. An armchair according to claim 12, further characterised in that said locking means comprises a detent housed in said connecting strut of the pivotal arm rest assembly which detent engages a forward end of said cantilevered support element and in that the detent is movable out of locking engagement with said cantilevered support element by a reciprocal rod movable by an actuating button provided at said forward end of the pivotal arm of the pivotal arm rest assembly.

16. An armchair according to claim 15, further characterised in that the detent resiliently is biased automatically to lock the pivotal arm rest assembly when the seat is returned to its lowered position.

* * * * *